US005990068A

United States Patent [19]

Brouwer et al.

[11] Patent Number: 5,990,068

[45] **Date of Patent: *Nov. 23, 1999**

[54] POWDER DETERGENT COMPOSITION HAVING IMPROVED SOLUBILITY

[75] Inventors: Steven J. Brouwer, Rockford; Michael J. Wint, Grand Rapids, both of Mich.

[73] Assignee: Amway Corporation, Mich.

[ * ] Notice: This patent is subject to a terminal disclaimer.

[21] Appl. No.: 09/041,064

[22] Filed: Mar. 10, 1998

Related U.S. Application Data

[63] Continuation of application No. PCT/US97/03678, Mar. 10, 1997, which is a continuation-in-part of application No. 08/617,941, Mar. 15, 1996, abandoned.

[51] Int. Cl.[6] ..... C11D 3/10; C11D 11/00; C11D 17/06

[52] U.S. Cl. ..... 510/276; 510/356; 510/444; 510/488; 510/509

[58] Field of Search ..... 510/276, 356, 510/444, 488, 509

[56] References Cited

U.S. PATENT DOCUMENTS

| | | |
|---|---|---|
| 3,446,893 | 5/1969 | Hanford et al. . |
| 3,579,455 | 5/1971 | Sabatelli et al. . |
| 3,597,361 | 8/1971 | Sumner . |
| 3,627,686 | 12/1971 | Sabatelli et al. . |
| 3,653,914 | 4/1972 | Schmitt . |
| 3,664,961 | 5/1972 | Norris . |
| 3,684,744 | 8/1972 | Shen et al. . |
| 3,700,599 | 10/1972 | Mizuno et al. . |
| 3,761,415 | 9/1973 | Gould . |
| 3,764,559 | 10/1973 | Mizuno et al. . |
| 3,769,222 | 10/1973 | Yurko et al. . |
| 3,799,880 | 3/1974 | Kelly et al. . |
| 3,801,511 | 4/1974 | Lemoff . |
| 3,846,346 | 11/1974 | Conn . |
| 3,850,852 | 11/1974 | Neillie et al. . |
| 3,886,098 | 5/1975 | DiSalvo et al. . |
| 3,896,056 | 7/1975 | Benjamin et al. . |
| 3,904,685 | 9/1975 | Shahidi et al. . |
| 3,920,586 | 11/1975 | Bonaparte et al. . |
| 3,922,230 | 11/1975 | Lamberti et al. . |
| 3,933,670 | 1/1976 | Brill et al. . |
| 3,933,673 | 1/1976 | Davies . |
| 3,950,260 | 4/1976 | Eldib . |
| 3,950,275 | 4/1976 | Toyoda et al. . |
| 3,962,149 | 6/1976 | Chirash et al. . |
| 3,993,574 | 11/1976 | Christ et al. . |
| 3,998,762 | 12/1976 | Murata et al. . |
| 4,028,262 | 6/1977 | Cheng . |
| 4,049,467 | 9/1977 | Rubin . |
| 4,051,054 | 9/1977 | Davies et al. . |
| 4,059,538 | 11/1977 | Green et al. . |
| 4,098,713 | 7/1978 | Jones . |
| 4,125,475 | 11/1978 | Kolaian et al. . |
| 4,140,650 | 2/1979 | Wilde . |
| 4,180,467 | 12/1979 | Barth . |
| 4,196,093 | 4/1980 | Clarke et al. . |
| 4,203,858 | 5/1980 | Chakrabarti . |
| 4,210,550 | 7/1980 | Cornelissens . |
| 4,216,104 | 8/1980 | Gergely . |
| 4,222,905 | 9/1980 | Cockrell, Jr. . |
| 4,234,442 | 11/1980 | Cornelissens . |
| 4,239,659 | 12/1980 | Murphy . |
| 4,248,911 | 2/1981 | Wixon . |
| 4,260,651 | 4/1981 | Wixon . |
| 4,272,393 | 6/1981 | Gergely . |
| 4,294,718 | 10/1981 | Kaeser . |
| 4,298,493 | 11/1981 | Schreiber . |
| 4,311,606 | 1/1982 | Kaeser . |
| 4,311,607 | 1/1982 | Kaeser . |
| 4,362,640 | 12/1982 | Schreiber . |
| 4,407,722 | 10/1983 | Davies et al. . |
| 4,416,809 | 11/1983 | Magari et al. . |
| 4,441,881 | 4/1984 | Ruppert et al. . |
| 4,444,674 | 4/1984 | Gray . |
| 4,457,854 | 7/1984 | Gangwisch et al. . |
| 4,473,485 | 9/1984 | Greene . |
| 4,524,013 | 6/1985 | Lamberti . |
| 4,534,876 | 8/1985 | Browne . |
| 4,557,853 | 12/1985 | Collins . |
| 4,576,727 | 3/1986 | Browne ..... 510/298 |
| 4,589,989 | 5/1986 | Mhller et al. . |
| 4,612,137 | 9/1986 | Kuroda et al. . |
| 4,619,710 | 10/1986 | Kuenn et al. . |
| 4,652,391 | 3/1987 | Balk . |
| 4,664,836 | 5/1987 | Taylor, Jr. et al. . |
| 4,666,740 | 5/1987 | Wixon . |

(List continued on next page.)

FOREIGN PATENT DOCUMENTS

| | | |
|---|---|---|
| 0 110 588 | 6/1984 | European Pat. Off. . |

OTHER PUBLICATIONS

Prieto et al., United States Statutory Invention Registration, Reg. No. H1467, Publication Date: Aug. 1, 1995.

*Primary Examiner*—Lorna M. Douyon
*Attorney, Agent, or Firm*—Brinks Hofer Gilson & Lione; G. Peter Nichols

[57] ABSTRACT

A powder laundry detergent has improved solubility in the laundering solution and improved dispensability by incorporating an acidulant that, in its acid form, is sparingly soluble in water and, in its salt form, is soluble in water. In particular, the acidulant is selected from the group of acids that in an acid form are soluble in water in an amount not greater than about 8%, preferably no greater than about 0.7% by weight at 25° C. and in a salt form are soluble in water at least in an amount of about 15% by weight at 25° C. A method of improving the solubility of a powder detergent includes admixing an acidulant in the powder detergent where the acidulant is selected from the group of acids that in an acid form are soluble in water in an amount not greater than about 8%, preferably not greater than about 0.7% by weight at 25° C. and in a salt form are soluble in water at least in an amount of about 15% by weight at 25° C.

9 Claims, No Drawings

U.S. PATENT DOCUMENTS 4,715,980 12/1987 Lopes et al. .
4,720,399 1/1988 Taha .
4,741,851 5/1988 Borrello .
4,806,173 2/1989 Toukan .
4,818,424 4/1989 Evans et al. .
4,820,441 4/1989 Evans et al. .
4,853,259 8/1989 Taha .
4,857,223 8/1989 Borrello .
4,869,843 9/1989 Saito et al. .
4,879,105 11/1989 Yorozu .
4,900,466 2/1990 Atkinson et al. .
4,919,847 4/1990 Barletta et al. .
4,923,628 5/1990 Appel et al. .
4,931,203 6/1990 Ahmed et al. .
4,954,292 9/1990 Hull et al. .
4,970,017 11/1990 Nakamura et al. .
4,992,079 2/1991 Lutz .
5,002,758 3/1991 Ichii et al. .
5,030,377 7/1991 Sone et al. .
5,030,379 7/1991 Knight et al. .
5,091,106 2/1992 Jacobs et al. .
5,108,646 4/1992 Beerse et al. ..... 510/532
5,133,924 7/1992 Appel et al. .
5,151,208 9/1992 Huijben et al. .
5,164,108 11/1992 Appel et al. .
5,198,144 3/1993 Ichii et al. .
5,259,994 11/1993 Welch et al. .
5,279,756 1/1994 Savio et al. .
5,300,250 4/1994 Morgan et al. .
5,312,561 5/1994 Hoshino et al. .
5,312,748 5/1994 Liu et al. .
5,314,637 5/1994 Saito et al. .
5,338,476 8/1994 Pancheri et al. .
5,415,806 5/1995 Pepe et al. .
5,458,799 10/1995 Flower .
5,468,416 11/1995 Outtrup et al. .
5,468,516 11/1995 Yamashita et al. .
5,470,509 11/1995 Pancheri .
5,714,451 2/1998 Brower et al. ..... 510/534

POWDER DETERGENT COMPOSITION HAVING IMPROVED SOLUBILITY

This application is a continuation of PCT/US97103678, filed on Mar. 10, 1997 which is a continuation-in-part of U.S. Ser. No. 08/617,941, filed on Mar. 15, 1996 now abandoned each of which are incorporated herein by reference in their entirety.

BACKGROUND OF THE INVENTION

1. Field of the Invention

The present invention relates to powder detergent compositions that have improved solubility in the laundering solution. More particularly, it relates to the addition of an acidulant to improve the solubility of powder detergent compositions in the laundering solution. The present invention also relates to the addition of an acidulant to improve the dissolution of those detergent compositions used in washing machines having a detergent-dispenser.

2. Discussion of Related Art

Granular laundry detergents containing admixed sodium carbonate are known to exhibit poor solubility under certain conditions. This poor solubility can cause clumps of detergent, which appear as solid white masses remaining in the washing machine and on washed clothes. Such clumps usually occur when the detergent is placed in a pile in the washing machine, particularly during cold water washes and/or when the order of addition to the washing machine is laundry detergent first, clothes second, and water last. The clumps may also occur when the powdered detergent is trapped within the folds or pockets of the fabrics to-be-washed, particularly in machines that do not provide for adequate agitation. It is believed that one contributor to this solubility problem is caused by hydration of the sodium carbonate and/or particle bridging resulting in a poorly soluble mass before the granular detergent can be dispersed and solubilized in the laundering solution.

Another problem exists when the laundry detergent contains high levels of nonionic surfactant. When such a detergent is added to the wash water, particularly when the temperature of the wash water is cool, the nonionic surfactant does not immediately solubilize. Instead, the surfactant may tend to gel resulting in a sticky mass which may deposit on the fabric before sufficient wash water is present to solubilize the nonionic surfactant.

U.S. Pat. No. 5,300,250 to Morgan et al. discloses that the addition of low levels of hydrophobic amorphous silicate material to granular laundry detergents containing admixed sodium carbonate improves their solubility in the laundering solution and eliminates or reduces the problem of clumps remaining in the washing machine and on washed clothes. The hydrophobic amorphous silicate material acts as an anti-caking agent and flow aid. The detergent is prepared by spray drying aqueous crutcher mixes of the surfactant and additives together with a premix containing sodium carbonate and hydrophobic amorphous silicate material.

U.S. Pat. No. 5,338,476 to Pancheri et al. discloses that spray dried granular laundry detergents having admixed sodium carbonate can achieve improved solubility in the laundering solution by incorporating citric acid. They report that they believe that the citric acid rapidly reacts with the sodium carbonate in the laundering solution to release carbon dioxide and helps to disperse the detergent and minimize the formation of insoluble clumps. The use of citric acid, in this manner, however, may not be desirable because a substantial portion of the citric acid may become neutralized to sodium citrate during storage. It is believed that the citric acid, which is hydroscopic, will absorb the free water present in the powder detergent formulation as well as in the atmosphere and become neutralized. The neutralization causes an unwanted increase in detergent particle size, powder lumps in the box, and loss of the desired effervescent effect.

U.S. Pat. No. 5,002,758 to Ichii et al. discloses bubbling bathing preparations preferably in the form of a tablet that contain fumaric acid and a carbonate together with carboxymethyl cellulose or an alkali metal salt or polyethylene glycol and less than 0.1% of a nonionic surface active agent. They also disclose that other organic acids may be used, for example, citric, tartaric, malic, malonic, pyridone carboxylic, succinic, adipic, phosphoric, and their salts.

A particular problem arises with the use of high density laundry detergent powders, i.e., those with bulk densities of 650 g/l or greater. Denser powders such as those of 800 g/l or higher are even more problematic. While these powders provide consumers the benefit of concentration and lower dosages, the processes required to produce high densities leave little or no void space in the detergent powder. For example, U.S. Pat. No. 5,133,924 describes a process that reduces the intraparticle porosity so that the void space is substantially decreased. These highly concentrated powders, however, can prove difficult to dissolve since the powder has little or no free space to allow the entry of water necessary for dissolution. This, in turn, can result in the powder forming localized areas of relation which remain undissolved at the end of the wash cycle and contribute to residue. As a result, they are more susceptible to the cold water clumping problems.

U.S. Pat. No. 5,415,806 to Pepe et al. describes high density laundry detergent compositions having a bulk density of 650 g/l or greater and intraparticle porosities of about 25% or less. They report that acceptable solubility and dispersion is achieved by including a $C_{2-4}$ alkylene oxide condensation product as a solubility aid. The process of making the described detergent composition includes preparing a base powder by mixing water plus detergent components in a slurry and spray drying the slurry. Consequently, the described process does not offer an improvement to the known disadvantages of spray drying. In addition, the compositions are those with high density but low porosity.

As a result, the amount of surfactant that can be effectively loaded is restricted. Moreover, without the solubility aid it is likely that the detergent would not be effectively dissolved or dispersed.

Another problem that exists with the use of higher density powder detergents is that they are not completely dispensed when used in automatic washing machines or those types of washing machines that are prevalent in Europe. In those machines, water enters the dispenser which is charged with the powder detergent and flushes the powder into the wash liquor. If the water does not flush out the entire amount of powder, the powder, when it solidifies, can form relatively large clumps that can eventually block the dispenser and/or feed pipe from the dispenser to the washing compartment of the machine. This wastes detergent and produces a lower level of cleaning. It also requires the user to clean out the dispenser and/or feed line, preferably after each wash cycle.

This problem is more prevalent with higher density powders, particularly in non-phosphate, zeolite-containing products and at low wash temperatures, including cold-water washes, and at low water pressure and/or water flow rates. While the phenomenon is not fully understood, solubilization of at least a portion of the powder detergent to form a pasty or syrupy consistency slurry before the powder has been washed out of the dispenser into the wash liquor appears to be a contributing factor.

SUMMARY OF THE INVENTION

It has now been discovered that the addition of an acidulant to a powdered laundry detergent improves the solubility of the detergent in the laundering solution and eliminates or reduces the problem of clumps remaining in the washing machine and on washed clothes. At the same time, the use of the acidulant as set forth in the present invention will not cause clumping of the powder detergent during storage. In addition, incorporation of the acidulant according to the present invention should result in improved dispensing, for example, in European side-flush dispensers.

It is believed that the acidulant as set forth in the present invention will find particular use in those powdered laundry detergents that have a high bulk density such as those described in U.S. Pat. No. 5,415,806, incorporated herein by reference. The acidulant is selected from the group of acids that, in an acid form, are no more than sparingly soluble in water and in a salt form are soluble in water. The cation portion of the acidulant when it is in its salt form may be selected from the group of alkali metal and alkaline earth cations. Typically, since a substantial portion of a laundering solution will contain cations such as potassium, sodium, calcium, and magnesium, the cation of the salt form of the acidulant will preferably be one of potassium, sodium, calcium, or magnesium.

Preferably, the acidulant is non-hydroscopic. The terms "relatively insoluble" and "sparingly soluble" as used in the following specification and claims means that the acid form of the acidulant has a solubility in water of no more than about 8% by weight at 25° C. In particular, the acidulant is selected from the group of acids that in an acid form are soluble in water in an amount not greater than about 0.7% by weight at 25° C. and in a salt form are soluble in water at least in an amount of about 15% by weight at 25° C. Examples of acidulants having the required solubility include, but are not limited to fumaric, succinic, adipic, and boric acid. Therefore, in a preferred embodiment, the acidulant is selected from the group consisting of fumaric, succinic, adipic, and boric acid. Most preferably, the acidulant is fumaric acid.

Generally, the powdered laundry detergent composition comprises, by weight, from about 5% to about 80% of an inorganic carrier and from about 1% to about 90% detergent surfactant selected from the group consisting of anionics, nonionics, zwitterionics, ampholytics, cationics, and mixtures thereof. The acidulant is incorporated into the powder detergent in an amount from about 0.1% up to about 15%, preferably, the weight ratio of inorganic carrier to acidulant is from about 2:1 to about 15:1, more preferably from about 5:1 to about 10:1.

In a preferred embodiment, the invention includes a powdered laundry detergent composition comprising, by weight, from about 20% to about 70% of an inorganic carrier, from about 10% to about 50% of a detergent surfactant selected from the group consisting of anionics, nonionics, zwitterionics, ampholytics, cationics, and mixtures thereof; and from about 0.1% up to about 15% of an acidulant, wherein the weight ratio of inorganic carrier to acidulant is from about 2:1 to about 15:1.

In a more preferred embodiment, the powder laundry detergent composition comprises an agglomerated powder detergent comprising an alkali metal carbonate and a detergent surfactant, to which the acidulant is post-added. The alkali metal carbonate is preferably sodium carbonate present at a level from about 5% to about 80%. The detergent surfactant is selected from the group consisting of anionics, nonionics, zwitterionics, ampholytics, cationics, and mixtures thereof. Preferably, the detergent surfactant is a nonionic surfactant. The surfactant is present at a level from about 1% to about 90%. The acidulant is selected from the group of acids that in an acid form are soluble in water in an amount not greater than about 8%, more preferably about 0.7%, by weight at 25° C. and in a salt form are soluble in water at least in an amount of about 15% by weight at 25° C. The acidulant is admixed with the agglomerated sodium carbonate and detergent surfactant at a level from about 0.1% up to about 15% by weight of the final product.

In this more preferred embodiment, the agglomerated sodium carbonate and detergent surfactant also contains an alkali metal carboxylate. The alkali metal carboxylate is the salt of a carboxylic acid, wherein the carboxylic acid is selected from those carboxylic acids that, below a first temperature, have a greater water solubility than the water solubility of its corresponding alkali-metal salt. As will be discussed below, the first temperature is from about 15° C. to about 40° C. Preferably, the alkali metal carboxylate is selected from the group consisting of sodium citrate, sodium malate, and mixtures thereof. The alkali metal carboxylate is formed during the agglomeration, upon the addition of water, by the reaction of the sodium carbonate with the carboxylic acid.

In accordance with the present invention, a method of improving the solubility of a powder laundry detergent is also provided. The method includes the steps of providing a powder detergent that comprises from about 5% to about 80%, preferably from about 20% to about 70%, of an inorganic carrier and from about 1% to about 90%, preferably from about 10% to about 50% of a detergent surfactant; admixing from about 0.1% up to about 15%, preferably up to about 10%, of an acidulant with the powder detergent wherein the acidulant is selected from the group of acids consisting of those that, in an acid form are soluble in an amount not greater than about 8%, more preferably not greater than about 0.7% by weight at 25° C. and in a salt form are soluble in water at least in an amount of about 15% by weight at 25° C.

In a preferred embodiment, the method is directed to improving the solubility of an agglomerated powder detergent that comprises the steps of providing an agglomerated powder detergent that comprises from about 5% to about 80% of an alkali metal carbonate and from about 1% to about 90% of a detergent surfactant and admixing with the agglomerated powder detergent, from about 0.1% up to about 15% of an acidulant wherein the acidulant is selected from the group of acids consisting of those that, in an acid form are soluble in an amount not greater than about 8%, preferably not greater than about 0.7% by weight at 25° C. and in a salt form are soluble in water at least in an amount of about 15% by weight at 25° C.

In this preferred embodiment, the process further includes preparing a premix that includes the step of loading sodium carbonate (and, optionally, other detergent ingredients) with a detergent surfactant to form a homogeneous surfactant coated alkali metal carbonate and admixing a carboxylic acid that is selected from the group of carboxylic acids that, below a first temperature, have a greater water solubility than the water solubility of its corresponding alkali-metal salt with the premix to form a mixture; incorporating water into the mixture to achieve agglomeration; drying the resulting agglomerate to form an agglomerated powder detergent; admixing the acidulant into the agglomerated powder detergent to produce a detergent having improved cold water solubility. The acidulant is selected from the group of acids consisting of those that, in an acid form are soluble in an amount not greater than about 8%, preferably not greater than about 0.7% by weight at 25° C. and in a salt form are soluble in water at least in an amount of about 15% by weight at 25° C.

The term "coated" is used in the following specification and claims to mean that the surfactant is present on the surface of the carbonate (and other particles), as well as within the carbonate (and other) particles, e.g., by absorption.

As used in the following specification and claims, all percentages are by weight.

DETAILED DESCRIPTION OF THE INVENTION AND PREFERRED EMBODIMENTS

The present invention relates to a powder laundry detergent composition that contains at least one post-added acidulant to improve the solubility of the powder laundry detergent, particularly in cold water washing. Generally, the powder detergent includes an inorganic carrier and a detergent surfactant. The acidulant is selected from the group of acids that in an acid form are soluble in water in an amount not greater than about 8%, preferably not greater than about 0.7% by weight at 25° C. and in a salt form are soluble in water at least in an amount of about 15% by weight at 25° C.

The inorganic carrier can be present in the detergent composition in an amount of about 5% to about 80% by weight of the final product. Generally, the amount of inorganic carrier present in the final product is balanced against the amount of surfactant present.

The inorganic carrier is preferably included in an amount from about 20% to about 70% by weight of the final product. More preferably, the inorganic carrier is present in the range from about 30% to about 65% by weight of the final composition.

Suitable inorganic carriers are preferably builders that are also capable of binding or precipitating the salts responsible for hardness in water. The builders herein include any of the conventional inorganic and organic water-soluble builder salts. Such builders can be, for example, water-soluble salts of phosphates including tripolyphosphates, pyrophosphates, orthophosphates, higher polyphosphates, carbonates, silicas, silicates, and organic polycarboxylates. Specific preferred examples of inorganic phosphate builders include sodium and potassium tripolyphosphates and pyrophosphates.

The inorganic carrier preferably contains little (e.g., less than 10%, preferably less than 5%, by weight) or no phosphate builder materials. Consequently, the nonphosphorous-containing materials are preferred and include the alkali metal, e.g., sodium and potassium, carbonates, and silicas. Other suitable carriers will be evident to those skilled in the art. For example, aluminosilicate ion exchange materials may be useful in the detergent composition of this invention and may include the naturally-occurring aluminosilicates or synthetically derived. A method for producing aluminosilicate ion exchange materials is discussed in U.S. Pat. No. 3,985,669, incorporated herein by reference. Such synthetic crystalline aluminosilicate ion exchange materials are available under the designations Zeolite A, Zeolite B, and Zeolite X. In addition, layered or structured silicates such as those sold under the designation SKS-6 by Hoechst-Celanese, may also find use as the inorganic carrier.

Preferably, the inorganic carrier is an alkali metal carbonate that may include minor amounts of other suitable carriers. Among the alkali metal carbonates useful in the laundry detergent of the present invention are light density (LT) soda ash (Solvay process), mixtures of light density (LT) and medium density soda ash (Sesquicarbonate process), a special high porosity "medium-light" ash (Sesquicarbonate process) and mixtures of light density and "medium-light" ash. These particles of sodium carbonate have an average density of from about 0.5 to about 0.7 and an average mesh size ranging from about 20 to about 200, U.S. Standard Sieve number. Carbonates such as these are commercially available from FMC Corp. and General Chemical and are relatively inexpensive as compared to more processed carbonates because they do not require further processing such as grinding.

The detergent surfactant is selected from the group consisting of anionics, nonionics, zwitterionics, ampholytics, cationics, and mixtures thereof. The detergent surfactant used in the present invention may be any of the conventional materials of this type which are very well known and fully described in the literature, for example in "Surface Active Agents and Detergents" Volumes I and II by Schwartz, Perry & Berch, in "Nonionic Surfactants" by M. J. Schick, and in McCutcheon's "Emulsifiers & Detergents," each of which are incorporated herein in their entirety by reference. In the preferred embodiment, where the powder detergent is made by agglomerating, the surfactant is a nonionic surfactant. The detergent surfactant is present at a level of from about 1% to about 90%. Desirably, the surfactant is present at a level of from about 10% to about 50%, and preferably, the surfactant is included in an amount in the range from about 20% to about 40%.

Useful anionic surfactants include the water-soluble salts of the higher fatty acids, i.e., soaps. This includes alkali metal soaps such as the sodium, potassium, ammonium, and alkyl ammonium salts of higher fatty acids containing from about 8 to about 24 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 8 to about 20 carbon atoms and a sulfonic acid or sulfuric acid ester group. Included in the term "alkyl" is the alkyl portion of acyl groups. Examples of this group of synthetic surfactants are the sodium and potassium alkyl sulfates, especially those obtained by sulfating the higher primary or secondary alcohols ($C_8$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. No. 2,220,099 and alkylbenzene sulfonates in which the average number of carbon atoms in the alkyl group is from about 11 to 14, abbreviated as $C_{11-14}$LAS.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

Other anionic surfactants that may be useful in the present invention include the secondary alkyl sulfates having the general formula

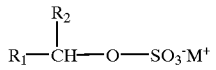

wherein M is potassium, sodium, calcium, or magnesium, R, represents an alkyl group having from about 3 to about 18 carbon atoms and $R_2$ represents an alkyl group having from about 1 to about 6 carbon atoms. Preferably, M is sodium, R, is an alkyl group having from about 10 to about 16 carbon atoms, and $R_2$ is an alkyl group having from about 1 to about 2 carbon atoms.

Other anionic surfactants useful herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl group contains from about 10 to about 20 carbon atoms.

The ether sulfates useful in the present invention are those having the formula $RO(C_2H_4O)_x,SO_3M$ wherein R is alkyl or alkenyl having from about 10 to about 20 carbon atoms, x is 1 to 30, and M is a water-soluble cation preferably sodium. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Another example of anionic surfactants that may be useful in the present invention are those compounds that contain two anionic functional groups. These are referred to as di-anionic surfactants. Suitable di-anionic surfactants are the disulfonates, disulfates, or mixtures thereof which may be represented by the following formula:

$$R(SO_3)_2M_2,R(SO_4)_2M_2,R(SO_3)(SO_4)M_2$$

where R is an acyclic aliphatic hydrocarbyl group having 15 to 20 carbon atoms and M is a water-solubilizing cation. Such di-anionic surfactants include the $C_{15}$ to $C_{20}$ dipotassium-1,2-alkyldisulfonates or disulfates, disodium 1,9-hexadecyl disulfates, $C_{15}$, to $C_{20}$ disodium 1,2-alkyldisulfonates, disodium 1,9-stearyidisulfates and 6,10-octadecyidisulfates The nonionic surfactant is preferably liquid at normal processing temperatures, i.e., at temperatures from about 25° C. to about 50° C. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, the nonionic surfactants may include the polyoxyethylene or polyoxypropylene condensates of aliphatic carboxylic acids, whether linear or branched chain and unsaturated or saturated, containing from about 8 to about 18 carbon atoms in the aliphatic chain and incorporating from about 5 to about 50 ethylene oxide or propylene oxide units. Suitable carboxylic acids include "coconut" fatty acid which contains an average of about 12 carbon atoms, "tallow" fatty acid which contains an average of about 18 carbon atoms, palmitic acid, myristic acid, stearic acid, and lauric acid.

The nonionic surfactants can also include polyoxyethylene or polyoxypropylene condensates of aliphatic alcohols, whether linear or branched chain and unsaturated or saturated, containing from about 8 to about 24 carbon atoms and incorporating from about 5 to about 50 ethylene oxide or propylene oxide units. Suitable alcohols include the coconut fatty alcohol, tallow fatty alcohol, lauryl alcohol, myristyl alcohol, and oleyl alcohol.

Preferred nonionic surfactants are of the formula $R^1(OC_2H_4)_nOH$, where $R^1$ is a $C_8$–$C_{18}$ alkyl group or a $C_8$–$C_{12}$ alkyl phenyl group, and n is from 3 to about 80. Particularly preferred nonionic surfactants are the condensation products of $C_8$–$C_{16}$ alcohols with from about 5 to about 20 moles of ethylene oxide per mole of alcohol, e.g., a $C_{12}$–$C_{16}$ alcohol condensed with about 5 to about 9 moles of ethylene oxide per mole of alcohol. Nonionic surfactants of this type include the NEODOL™ products, e.g., Neodol 23–6.5, Neodol 25–7, and Neodol 25–9 which are, respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

Alkyl saccharides may also find use in the composition. In general, the alkyl saccharides are those having a hydrophobic group containing from about 8 to about 20 carbon atoms, preferably from about 10 to about 16 carbon atoms, and a polysaccharide hydrophilic group containing from about 1 (mono) to about 10 (poly), saccharide units (e.g., galactoside, glucoside, fructoside, glucosyl, fructosyl, and/or galactosyl units). Mixtures of saccharide moieties may be used in the alkyl saccharide surfactants. Preferably, the alkyl saccharides are the alkyl glucosides having the formula $$R^1O(C_nH_{2n}O)_t(Z)_X$$

wherein Z is derived from glucose, $R^1$ is a hydrophobic group selected from the group consisting of alkyl, alkylphenyl, hydroxyalkyl, hydroxyalkylphenyl, and mixtures thereof in which the alkyl groups contain from about 10 to about 18 carbon atoms, n is 2 or 3, t is from 0 to about 10, and x is from 1 to about 8. Examples of such alkyl saccharides are described in U.S. Pat. No. 4,565,647 (at col. 2, line 25 through col. 3, line 57) and U.S. Pat. No. 4,732,704 (at col. 2, lines 15–25), the pertinent portions of each are incorporated herein by reference.

In a preferred embodiment, the detergent surfactant is selected from the group of nonionics, wherein the nonionic is sole detergent surfactant present and in this preferred embodiment the nonionic surfactant is included in an amount about 1% to about 90%, desirably from about 10% to about 50%. More preferably, the nonionic surfactant is included in an amount of from about 20% to about 40%.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

The powder detergent composition may optionally contain other well known adjuncts for detergent compositions. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in, for example, U.S. Pat. No. 3,936,537, incorporated herein by reference.

Water-soluble, organic builders may also find use in the detergent composition of the present invention. For example, the alkali metal, polycarboxylates such as sodium and potassium, salts of ethylenediaminetetraacetic acid, nitrilotriacetic acid, oxydisuccinic acid, mellitic acid, benzene polycarboxylic acid, polyacrylic acid, and polymaleic acid may be included.

Other polycarboxylate builders are the builders set forth in U.S. Pat. No. 3,308,067, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. Nos. 4,144,226, and 4,246,495, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Bleaching agents and activators that may find use in the present detergent composition are described in U.S. Pat. Nos. 4,412,934, and 4,483,781, both of which are incorporated herein by reference. Suitable bleach compounds include sodium perborate, sodium percarbonate, etc. and the like, and mixtures thereof. The bleach compounds may also be used in combination with an activator such as, for example, tetra-acetyl-ethylenediamine (TAED), sodium nonanoyloxybenzene sulfonate (SNOBS), diperoxydodecanedioc acid (DPDDA) and the like, and mixtures thereof. Chelating agents are described in U.S. Pat. No. 4,663,071, from column 17, line 54 through column 18, line 68, incorporated herein by reference. Suds modifiers are also optional ingredients and are described in U.S. Pat. Nos. 3,933,672, and 4,136,045, both incorporated herein by reference.

Smectite clays may be suitable for use herein and are described in U.S. Pat. No. 4,762,645, at column 6, line 3 through column 7, line 24, incorporated herein by reference. Other suitable additional detergency builders that may be used herein are enumerated in U.S. Pat. No. 3,936,537, column 13, line 54 through column 16, line 16, and in U.S. Pat. No. 4,663,071, both incorporated herein by reference.

The detergent may also contain whitening agents including the discrete whitening agent particles which are fully described in U.S. application Ser. No. 08/616,570 now U.S Pat. No. 5,714,452 and U.S. application Ser. No. 08/616,208, both of which are incorporated herein by reference.

The laundry detergent compositions of the present invention can be formulated to provide a pH (measured at a concentration of 1% by weight in water at 20° C.) of from about 7 to about 11.5. A pH range of from about 9.5 to about 11.5 is preferred for best cleaning performance.

The powder detergent compositions of the present invention may be produced by any of the well known methods. For example, the powder detergent may be produced by spray drying as disclosed in U.S. Pats. Nos. 5,338,476 and 5,415,806, each incorporated herein by reference in their entirety. The detergent composition may also be prepared by agglomerating as set forth in U.S. Pats. Nos. 4,473,485, 5,164,108, and 5,458,799, each incorporated herein by reference in their entirety. For example, the powder detergent may be agglomerated in the manner fully set forth in U.S. Pat. No. 5,496,486, the entire disclosure of which is incorporated herein by reference.

In a preferred embodiment, the detergent composition is an agglomerated powder detergent containing an alkali metal carbonate loaded with a surfactant as more particularly described in U.S. application Ser. No. 08/616,568 now abandoned and is made by the process disclosed in U.S. patent application Ser. No. 081616,443, now abandoned both of which are incorporated herein by reference.

In this preferred embodiment, the detergent composition comprises three essential ingredients: sodium carbonate, a surfactant and a substantially completely neutralized carboxylic acid.

Among the preferred sodium carbonates are those described above. The sodium carbonate can be present in an amount of about 5% to about 80% by weight of the final product. The amount of sodium carbonate added to the final product is balanced against the amount of surfactant which will be loaded into the sodium carbonate as well as the amount which will be neutralized by the admixed carboxylic acid. The preferred range for the sodium carbonate is from about 20% to about 70%, more preferably from about 30% to about 65% by weight of the final product. It should be mentioned that within the preferred range the higher levels tend to be required under conditions of use at low product concentrations, as is commonly the practice in North America, and the converse applies under conditions of use at higher product concentrations, as tends to occur in Europe.

If desired, the sodium carbonate can be mixed with other minor amounts, not to exceed about 10% of the final product, of detergent ingredients before the surfactant is added to it. The order of addition is not critical so long as the carbonate is adequately coated with the surfactant. For example, the carbonate, optional detergent ingredients, and surfactant may be mixed in the manner fully disclosed in U.S. Pat. Nos. 5,458,769 or 5,496,486, the entire disclosure of both are incorporated herein by reference.

Preferably, a minor amount, from about 0.1% up to about 5%, of a silica such as a silicon dioxide hydrate is mixed with the sodium carbonate prior to loading with the surfactant. A variety of siliceous substances are acceptable for addition to the detergent composition, although highly absorbent silica of the precipitated or fumed variety is preferred. The preferred siliceous compounds have oil absorption numbers of 150 to about 350 or greater, preferably about 250 or greater. As examples of operable silicas, the following siliceous material are representative: Sipernat 50, Syloid 266, Cabosil M-5, Hisil 7–600. Preferably, from about 0.5% to about 4% by weight of the final product, of silica is mixed with the sodium carbonate prior to loading by the surfactant. More preferably, from about 3% to about 4% of silica by weight of the final product is mixed with the sodium carbonate.

Low levels of carboxymethylcellulose, for example from about 0.1% up to about 5%, to aid in the prevention of soil suspended in the wash liquor from depositing onto cellulosic fabrics such as cotton, may also be mixed with the sodium carbonate prior to loading with the surfactant. Preferably, from about 1% to about 3%, more preferably from about 2% to about 3% of carboxymethylcellulose is mixed with the sodium carbonate prior to loading with the surfactant. In a preferred embodiment, both the silica and the carboxymethylcellulose are mixed with the sodium carbonate prior to being loaded with the surfactant.

The second essential ingredient is a detergent surfactant which may be any of the surfactants described above. Although the preferred surfactant is a nonionic surfactant, it is to be understood that any of the surfactants described above can be used individually or in combination. Thus, while the description below refers to nonionic surfactants, it is to be understood that the surfactants described above can be used with or without any nonionic surfactant and individually or in combination.

Preferably, the surfactant is a nonionic surfactant such as an ethoxylated alcohol, as described above. Nonionic surfactants of this type include the NEODOL™ products, e.g., Neodol 23–6.5, Neodol 25–7, and Neodol 25–9 which are respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

Desirably, the ratio of sodium carbonate to nonionic surfactant is from about 2:1 to about 3.5:1. Preferably, the ratio is from about 2.2:1 to about 3.3:1, more preferably from about 2.3:1 to about 2.8:1. In the most preferred embodiment the ratio of sodium carbonate to nonionic surfactant is about 2.4:1.

The nonionic surfactants are therefore incorporated in an amount of about 5% to about 50% by weight of the final product. Of course, the detergent benefits of high nonionic concentration must be balanced against cost-performance. Therefore, the preferred range for the nonionic surfactants is from about 20% to about 40% by weight of the final product, more preferably, from about 20% to about 30%. Most preferably, the nonionic surfactant is present at a level of about 25%. It should be mentioned that within the above ranges the lower levels tend to be required under conditions of use at higher product concentrations, as is commonly the practice in Europe, and the converse applies under conditions of use at lower product concentrations, as tends to occur in North America and Asia.

In this preferred embodiment, from about 5% to about 80% sodium carbonate is blended with from about 5% to about 50% of a nonionic surfactant, wherein the nonionic surfactant is the sole surfactant present to form a form a premix comprising a homogeneous mixture of nonionic surfactant coated sodium carbonate. More preferably, the premix is formed by blending from about 20% to about 70% of sodium carbonate with up to about 5%, preferably from about 0.5% to about 4% of silica, and from about 1% to about 3% of minor detergent ingredients including carboxymethylcellulose and, loading the sodium carbonate, silica, and carboxymethylcellulose with from about 20% to about 40% of a nonionic surfactant wherein the nonionic surfactant is the sole surfactant present in the premix. In a more preferred embodiment, the premix is formed by mixing from about 30% to about 65% of sodium carbonate, from about 0.5% to about 4% of a silica, from about 2% to about 3% of carboxymethylcellulose, and a minor amount of other optional detergent ingredients; and spraying from about 20% to about 30% of a nonionic surfactant wherein the nonionic surfactant is the sole detergent surfactant present, onto the mixed carbonate, silica, carboxymethylcellulose, and optional ingredients.

Loading, adsorption, and absorption of the surfactant onto the sodium carbonate (and into its porous structure) can be achieved by, for example, simple admixture with sufficient agitation to distribute the surfactant entirely on and within the sodium carbonate to form a premix comprising a homogeneous mixture of surfactant coated sodium carbonate. As noted above, the term "coated" includes absorption into carbonate particles. The loading can be accomplished in any of the known mixers such as by a ribbon or plow blender. Preferably, the surfactant is sprayed onto the sodium carbonate and other optional ingredients, if present, while they are agitated. In preparing the premix of the present invention, it is important that the sodium carbonate is sufficiently coated with the surfactant so that when water is later added, the water does not immediately contact uncoated carbonate and hydrate the carbonate. It is believed that excessive hydration of the carbonate reduces the amount of water available to solubilize the carboxylic acid which will require additional water to achieve the desired agglomerated particle size.

At the same time, if an excess amount of surfactant is present in the premix, the later admixed carboxylic acid may be coated with the excess surfactant. As a result, the amount of carboxylic acid available to solubilize and neutralize with the sodium carbonate will be reduced, which, in turn will reduce the agglomeration efficiency and require additional carboxylic acid to achieve the desired particle size.

As discussed above, the surfactant is added in an amount so that it is within a particular ratio with respect to the sodium carbonate. Within this ratio range, the surfactant adequately coats the sodium carbonate yet does not provide a substantial excess of surfactant which would then undesirably coat the carboxylic acid. Moreover, it is believed that the order of addition is important to achieving the desired agglomeration.

By loading the sodium carbonate with the surfactant prior to the admixture of carboxylic acid and introduction of water, the desired particle size is achieved while still producing a free-flowing powder.

The third essential ingredient is the sodium salt of a carboxylic acid wherein the carboxylic acid is selected from those carboxylic acids that, below a first temperature, have a greater water solubility than the water solubility of its corresponding sodium salt. As will be discussed below, the first temperature is from about 15° C. to about 40° C. Preferably, the sodium carboxylate is provided solely by the reaction of the corresponding carboxylic acid and the sodium carbonate. Preferred sodium carboxylates are selected from the group consisting of sodium citrate, sodium malate, and mixtures thereof. Sodium citrate is the most preferred because citric acid is relatively inexpensive and is readily obtainable.

The sodium carboxylate is present in the detergent composition at a level from about 0.1% up to about 25%, preferably from about 4% to about 18% and is provided solely by the reaction of the carboxylic acid and the sodium carbonate. It is believed that when the amount of sodium carboxylate is within this range, the desired agglomeration of the surfactant loaded sodium carbonate will be efficiently achieved and will produce the desired particle size. More preferably, the sodium carboxylate is present at a level of from about 5% to about 13% and in the most preferred embodiment is present at a level of about 9% to about 11%.

Desirably, as will be further discussed below, the carboxylic acid should be substantially completely neutralized by reaction with the sodium carbonate to its corresponding sodium salt during processing. For example, malic acid should be substantially completely neutralized to sodium malate. Because of reaction and processing limitations, it is believed that the carboxylic acid is not completely neutralized. Therefore, it is desirable to neutralize at least about 90%, preferably at least about 95% and more preferably at least about 99% of the carboxylic acid to its sodium carboxylate. Preferably, the substantially completely neutralized carboxylic acid will be selected from the group consisting of the sodium salts of citric acid, malic acid, and mixtures thereof.

The amount of carboxylic acid to be admixed can be determined from the amount of substantially completely neutralized carboxylic acid desired in the final product as well as the amount of sodium carbonate present. It would be desirable to use the minimum amount of carboxylic acid necessary to achieve acceptable agglomeration. This amount, however, must be balanced against the desire to provide an amount of the sodium carboxylate in the final product sufficient to control hard water filming in those instances where hard water is used. Acid levels which are too high can result in lower alkalinity by neutralization of the sodium carbonate which can detrimentally affect detergent performance. Too little acid, on the other hand, reduces the ability of the acid salt hydrate to entrap the added moisture and hampers agglomeration. The carboxylic acid is therefore incorporated in an amount such that the ratio between the sodium carbonate and the carboxylic acid is in the range from about 6.5:1 to about 12:1, preferably in the range from about 6.5:1 to about 8:1, more preferably about 7:1.

The carboxylic acid is admixed with the premix at a level from about 0.1% up to about 18% by weight of the final product. The preferred range of admixed acid is from about 3% to about 13% by weight of the final product, more preferably from about 4% to about 10% and most preferably from about 7% to about 9%. The carboxylic acid is only lightly admixed with the premix prior to the later introduction of water to minimize the potential for coating of the carboxylic acid by the surfactant.

After the carboxylic acid is lightly admixed with the premix, a small amount of water is incorporated to accomplish agglomeration of the particles. The water may be incorporated as a mist, steam, or in another suitable fashion. Desirably, the amount of water used is as small as practical in order to minimize subsequent drying time, energy and thus cost, for example at least about 0.1%. The water is therefore incorporated at a level from about 0.1% to no more than about 7%, preferably no more than about 5%. In a more preferred embodiment, the water is incorporated in a range between about 4% and about 5%.

The water is incorporated into the mixture using any suitable mixing apparatus to achieve agglomeration of the mixture. Preferably, a drum agglomerator is used. The agglomerator rotates to distribute the mixture along the length of the drum as the falling sheets of the mixture are sprayed with water to produce a well controlled agglomeration of the particles.

Without wishing to be bound by any particular theory, it is believed that the carboxylic acid is solubilized and neutralized by the sodium carbonate at the same time the sodium carbonate is hydrated. The carboxylic acid should be substantially completely neutralized to its corresponding sodium salt which, below a first temperature, is less water soluble than the acid form. During the neutralization of the carboxylic acid, the sodium carboxylate binds the surfactant coated sodium carbonate particles to agglomerate them and to produce the desired particle size. As the drum rotates and the particles are agglomerated, the larger particles move from the inlet end to the outlet end of the agglomerator where they exit and are conveyed to a dryer to remove the free water from the agglomerated particles. The agglomerator is preferably inclined from the inlet to the outlet so that as the particles agglomerate, the larger agglomerated particles move from the inlet end to the outlet end where they are conveyed to an air dryer to be dried.

In particular, while not wishing to be held to a specific theory, it is believed that the carboxylic acid is solubilized with the water and reacts with the sodium carbonate to become substantially completely neutralized. The salts of the carboxylic acids, for example, citric and malic, have a water solubility less than their acid form below a first temperature and therefore the salts come out of solution to bind and thus agglomerate the particles. As noted above, insufficient coating by the surfactant on the surface of the sodium carbonate will produce excessive hydration of the sodium carbonate. As a result, the water required to solubilize the carboxylic acid will not be available and additional water and processing time will be required to produce the desired agglomerated particle size. In addition, hydration of sodium carbonate is exothermic and excessive hydration of sodium carbonate will generate undesirable heat and increase the temperature of the mixture above the first temperature. At the same time, an excess of surfactant present in the premix may cause coating of the carboxylic acid resulting in a reduction of agglomeration efficiency. In addition, additional carboxylic acid and water may be required to achieve the desired agglomerated particle size. Consequently, the order of addition as well as the temperature are believed to be important to achieving the desired agglomeration and particle size.

It is believed that by adding the carboxylic acid after the premix has been formed, the desired solubilization of the carboxylic acid is achieved prior to a substantial reaction with the sodium carbonate. If the citric acid were admixed with the sodium carbonate prior to adding the surfactant, it is believed that the resulting product would not achieve the desired free flowing and dissolution properties.

As noted above, the preferred carboxylic acid has a greater water solubility than its corresponding sodium salt below a first temperature. An increase in temperature above the first temperature therefore adversely affects the relative solubility of the acid form of the carboxylic acid in comparison to the salt form which, in turn, adversely affects the agglomeration efficiency. As a result, the formation of the sodium salt of the carboxylic acid is controlled so as to prevent the temperature of the mixture from rising above the first temperature.

Generally, the first temperature can range from about 15° C. to about 40° C., preferably from about 32° C. to about 35° C. A first temperature higher than about 42° C. appears to adversely affect the product characteristics and is, therefore, undesirable.

It will be understood by one skilled in the art that several factors can be varied to control the residence time (i.e., the weight of the mixture on the bed divided by the total feed rate) and agglomerate size, e.g., feed rate to the drum, angle of the drum, rotational speed of the drum, the number and location of the water spray. The result of manipulating such factors is desired control of the particle size and density of the agglomerates that sent to the dryer.

The wetted agglomerated particles are dried to remove any free water. The drying may be accomplished by any known method such as by a tumbling dryer or air drying on a conveyor. As one skilled in the art will appreciate, the time, temperature, and air flow may be adjusted to provide for an acceptable drying rate. Using a high ambient temperature in the dryer can shorten the residence time in the dryer, while lower temperatures may unduly lengthen the residence time. Short residence times, however, may increase the risk of adversely affecting the stability of the agglomerates or of incompletely drying the agglomerate.

It is desirable to remove as much water as practicable since the presence of water, even when bound, may detrimentally react with post-added moisture sensitive detergent ingredients such as bleaches and enzymes. In addition, the presence of water may, over time and under typical storage conditions, cause product caking. Therefore, in a preferred embodiment, a minor amount of water is added to accomplish agglomeration and furthermore, at least about 50% of the added water is removed by drying. More preferably, at least about 60% of the added water is removed by drying. Consequently, the resulting composition contains less than about 3% of bound water, more preferably less than about 2% of bound water.

The dried particles have an average particle mesh size up to about 20 U.S. Standard Sieve number. Preferably, the particles have a particle mesh size such that about 90% of the particles are in the range from about 20 to about 100 U.S. Standard Sieve number. The resulting powder has a bulk density of at least 0.7 g/cc, preferably from about 0.8 to about 0.9 g/cc, more preferably from about 0.85 to about 0.9 g/cc.

The mixing steps in the process to prepare the detergent compositions of this preferred embodiment can be accomplished with a variety of mixers known in the art. For example, simple, paddle or ribbon mixers are quite effective although other mixers, such as drum agglomerators, fluidized beds, pan agglomerators and high shear mixers may be used.

As indicated above, the acidulant is post-added to the powder detergent in an amount from about 0.1% up to about 15% by weight of the final product. In this context, post-added refers to adding the acidulant to the detergent after it has been dried, e.g. by spray drying or other method, and is ready to be packaged. The amount of acidulant admixed with the detergent is balanced against the amount and type of inorganic carrier, and other manufacturing and consumer preferences. Preferably, the acidulant is incorporated in an amount from about 1% to about 10%, more preferably about 5% by weight of the final product.

The acidulant is selected from the group consisting of acids that, in an acid form are soluble in water in an amount not greater than about 8%, preferably not greater than about 0.7% by weight at 25° C. and in a salt form are soluble in water at least in an amount of about 15% by weight at 25° C. Generally, substances that have a solubility in water not greater than about 8% by weight are considered to be sparingly soluble in water. In addition, acidulants having the desired solubility profile will typically not be hydroscopic. Consequently, caking, which is prevalent in powder detergents, particularly those having citric acid, is reduced, if not eliminated.

Examples of acidulants having the required solubility include fumaric acid, adipic acid, succinic acid, and boric acid. The acidulant is therefore selected from the group of acids consisting essentially of fumaric, adipic, succinic and boric acid and mixtures thereof. Preferably, the acidulant is fumaric acid.

The cation portion of the salt of the acidulant will generally be an alkali metal or alkaline earth metal. Preferably, the cation will be potassium, sodium, calcium or magnesium since a substantial portion of the laundering solution will contain those cations. More preferably, when the inorganic carrier is an alkali metal, particularly sodium carbonate, the cation will be sodium since the acidulant will react with the sodium carbonate of the powder detergent. In this more preferred embodiment, the acidulant is incorporated into the powder detergent in an amount such that the ratio of sodium carbonate to acidulant is from about 2:1 to about 15:1 more preferably from about 5:1 to about 10:1.

In a more preferred embodiment, the powder laundry detergent composition comprises an agglomerated powder comprising an alkali metal carbonate, a detergent surfactant, and an alkali metal carboxylate, with post-admixed acidulant. The alkali metal carbonate is preferably sodium carbonate present at a level from about 5% to about 80%. The detergent surfactant is selected from the group consisting of anionics, nonionics, zwitterionics, ampholytics, cationics, and mixtures thereof and is present at a level from about 1% to about 90%. The alkali metal carboxylate is the salt of a carboxylic acid, wherein the carboxylic acid is selected from those carboxylic acids that, below a first temperature, have a greater water solubility than the water solubility of its corresponding alkali-metal salt. The alkali metal carboxylate is formed during the agglomeration of the nonionic surfactant coated sodium carbonate. Preferably, the alkali metal carboxylate is selected from the group consisting of sodium citrate, sodium malate, and mixtures thereof. The acidulant is selected from the group of acids that in an acid form are soluble in water in an amount not greater than about 8%, preferably not greater than about 0.7% by weight at 25° C. and in a salt form are soluble in water at least in an amount of about 15% by weight at 25° C. The acidulant is admixed with the agglomerated sodium carbonate and detergent surfactant at a level from about 0.1% up to about 15% by weight of the final product.

The present invention also contemplates a method to improve the solubility of a powder detergent by admixing an acidulant into a powder detergent. In one embodiment, the method comprises providing a powder detergent that comprises from about 5% to about 80% of an inorganic carrier and from about 1% to about 90% of a detergent surfactant; admixing an acidulant wherein the acidulant is selected from the group of acids that in an acid form are soluble in water in an amount not greater than about 8%, preferably not greater than about 0.7% by weight at 25° C. and in a salt form are soluble in water at least in an amount of about 15% by weight at 25° C.

The acidulant may be admixed with the powder detergent in any suitable fashion with a variety of mixers known in the art such as simple, paddle or ribbon mixers although other mixers, such as ribbon or plow blenders, drum agglomerators, fluidized beds, pan agglomerators and high shear mixers may be used. Preferably, the acidulant is admixed with the powder detergent after any water removal step. For example, it is known to spray dry a detergent mix to remove excess water. It is also known to dry detergents that have been made by an agglomerating process. Therefore, the acidulant is admixed with the dried detergent.

In a preferred embodiment, the method is directed to improving the solubility of an agglomerated powder detergent that comprises the steps of providing an agglomerated powder detergent that comprises from about 5% to about 80% of an alkali metal carbonate and from about 1% to about 90% of a surfactant and admixing with the agglomerated powder detergent, from about 0.1% up to about 15% of an acidulant wherein the acidulant is selected from the group of acids consisting of those, that in an acid form are soluble in an amount not greater than about 8%, preferably not greater than about 0.7% by weight at 25° C. and in a salt form are soluble in water at least in an amount of about 15% by weight at 25° C.

In this preferred method, the process further includes preparing a premix that includes the step of loading sodium carbonate with a surfactant to form a homogeneous surfactant coated alkali metal carbonate; admixing a carboxylic acid that is selected from the group of carboxylic acids that, below a first temperature, have a greater water solubility than the water solubility of its corresponding alkali-metal salt with the premix to form a mixture; incorporating water into the mixture to achieve agglomeration; drying the resulting agglomerate to form an agglomerated powder detergent. An acidulant selected from the group of acids consisting of those that, in an acid form are soluble in an amount not greater than about 8%, preferably not greater than about 0.7% by weight at 25° C. and in a salt form are soluble in water at least in an amount of about 15% by weight at 25° C. is admixed with the agglomerated powder detergent to produce a detergent having improved cold water solubility and improved dispensability.

Advantageously, the detergent composition resulting from the post-addition of the acidulant in accordance with the present invention is soluble in cool or cold water, i.e., the composition readily dissolves or disperses in water having a temperature between about 32° F. (0° C.) and 90° F. (32.2° C.), preferably between about 35° F. (1.6° C.) and 50° F. (10° C.) In particular, it has been found that the post addition of the acidulant described above results in a powder detergent that readily dissolves as compared to a powder detergent that does not contain the post addition of the acidulant. Because of the incorporation of the acidulant, no significant amount of product remains bound in the clothes or in the bottom of the washing machine after a typical cold water wash cycle, even when the order of addition to the washing machine has been reversed, i.e., detergent first, clothes second, and water last. In addition, it is believed that incorporation of the acidulant according to the present invention will increase the dispensability of the detergent from a dispenser for automatic washing machines such as European-style side flush dispensers.

Thus, the present invention includes enhancing the dispensability of powder detergents by post-adding to those detergents an effective amount of an acidulant, as defined above.

The advantages and other characteristics of the present inventions are best illustrated by the following examples.

EXAMPLE 1

The following example shows the beneficial effect of post-adding an acidulant to a powder detergent according to the present invention when compared to a powder detergent without the post-added acidulant as well as to powder detergents containing citric acid or its salt. The powder detergent contained the following ingredients: 56% of sodium carbonate, 3.2% of silica, 2.1% of carboxymethylcellulose, 23.2% of Pareth 25–7 (a $C_{12-15}$ alcohol ethoxylated with 7 moles of ethylene oxide), 7.9% of citric acid, 4.2% of added water (with 2.6% removed by drying), with 6% of detergent ingredients such as fragrance, enzyme, anionic surfactant and fluorescent whitening agent. Each of the examples were tested in the following manner. A 20 gram amount of each substance to-be-tested was weighed and transferred to an open 4 ounce jar. The jar was stored for 3 days at 100° F. and 80% relative humidity. The results are reported in Table 1.

TABLE 1

| Material | Condition after storage |
|---|---|
| Citric Acid | very wet syrupy cake |
| Fumaric Acid | surface crust, but not wet |
| A 2:1 mixture of citric acid to fumaric acid (Provided as Ultraspheres by Haarmann & Riemer | wet, particles stuck together |
| Ultraspheres of citric acid | wet, particles stuck together |
| Ultraspheres of monosodium citrate | wet, particles stuck together |
| Powder detergent | surface crust |
| Powder detergent containing 5% by weight citric acid | caked solid |
| Powder detergent containing 5% by weight fumaric acid | surface crust |
| Powder detergent containing 5% by weight of ultraspheres of monosodium citrate | caked solid |
| Powder detergent containing 5% by weight of ultraspheres of a 2:1 ratio of citric to fumaric acid | caked |

EXAMPLES 2–5

A number of formulations are presented in Table 2 to outline the scope of this invention. Various types of acidulants as shown in Examples 2–5 may be added to the powder detergent.

TABLE 2

| Example No. | 2 | 3 | 4 | 5 |
|---|---|---|---|---|
| Material | | | | |
| Sodium Carbonate | 53.18 | 53.18 | 53.18 | 53.18 |
| Silica | 3.0 | 3.0 | 3.0 | 3.0 |
| Carboxymethyl-cellulose | 2.0 | 2.0 | 2.0 | 2.0 |
| Citric Acid | 7.5 | 7.5 | 7.5 | 7.5 |
| Pareth 25-7 | 22.0 | 22.0 | 22.0 | 22.0 |
| Water (for reaction) | 4.0 | 4.0 | 4.0 | 4.0 |
| Water (removed) | 2.5 | 2.5 | 2.5 | 2.5 |
| Post-added Adipic acid | 5.0 | — | — | — |
| Post-added Succinic acid | — | 5.0 | — | — |
| Post-added Boric acid | — | — | 5.0 | — |
| Post-added Fumaric acid | — | — | — | 5.0 |
| Post-added whitening agent particles | 3.6 | 3.6 | 3.6 | 3.6 |
| Post-added optionals | 2.22 | 2.22 | 2.22 | 2.22 |

Test Procedure

In the following examples, the following test was used to provide an indication of the ability of a powder detergent to dissolve in a wash liquor. An acrylic sock is filled with a measured amount of the to-be-tested detergent. The detergent is pushed to the toe of the sock. The sock is closed by using a tie wrap. To simulate typical wash conditions in North America, a washing machine prevalent in North America is used, for example, a Maytag washing machine. In this case, 30 grams of the to-be-tested detergent is put into the sock. Likewise, to simulate typical wash conditions in Japan, a washing machine prevalent in Japan is used, for example, a National washing machine. In this case, 12.5 grams of the to-be-tested detergent is put into the sock. The washing machine is set on a regular fabric wash cycle and is filled with water (17 gallons for the U.S. washer and 40 liters for the Japanese washer) at the desired temperature. The sock is placed into the water followed by a six-pound bundle of fabrics. The fabrics are washed and the sock is removed at the end of the wash cycle just at the onset of the rinse cycle. The sock is dried at ambient temperature. When dry, the sock is opened to determine if any powder detergent remains within the sock. A sock containing any powder detergent is considered to have failed the test. A sock containing no powder detergent is considered to have passed the test. The water temperature is decreased in 5° F. increments until powder remains in the sock. Since water having a temperature less than 45° F. was not available, the lowest water temperature tested was 45° F.

EXAMPLES 6–7

The following example demonstrates the effectiveness of the post-added acidulant in a dry blended detergent. In this example, the detergent was formulated by simply admixing the detergent ingredients. The detergents in examples 6 and 7 of Table 3 were tested in the sock test described above and did not fail until 50° F.; thus, demonstrating the beneficial effect of the post-added acidulant.

TABLE 3

| Example No. | 6 | 7 |
|---|---|---|
| Material | | |
| Sodium Carbonate | 61.18 | 56.18 |
| Silica | 4.0 | 4.0 |
| Carboxymethylcellulose | 2.0 | 2.0 |
| Pareth 25-7 | 22.0 | 22.0 |
| Post-added Fumaric acid | 5.0 | 10.0 |
| Post-added detergent ingredients (fragrance, enzymes, whiteners) | 5.82 | 5.82 |

EXAMPLES 8–12

The following examples show the effectiveness of post-added acidulant. The sock test described above was used to determine the temperature of failure. Each detergent tested provided an identical amount of the nonionic surfactant to the wash liquor. For example, when the detergent of Example 8 was tested (it contained the ingredients described above for example 1), only 28.5 grams was used so that 22% by weight of the nonionic surfactant was being tested. Examples 9–12 used the powder detergent described in example 5. Example number 12 shows that post added citric acid is effective in achieving acceptable dissolution. However, as demonstrated in Example 1 and Table 1, the post-addition of citric acid detrimentally causes caking of the powder detergent.

TABLE 4

| Example No. | 8 | 9 | 10 | 11 | 12 |
|---|---|---|---|---|---|
| Material | | | | | |
| Powder Detergent | 100 | 95 | 90 | 85 | 95 |
| Post-added fumaric acid | — | 5 | 10 | 15 | — |
| Post-added citric acid | — | — | — | — | 5 |
| Temperature at failure (° F.) | 70 | <45 | <45 | 50 | 50 |

Comparative Examples

The following commercially available powder detergents were tested in the sock test described above. The amount of detergent tested was based on the manufacturer's recommended use level.

TABLE 5

| Material | Temperature at failure (° F.) |
|---|---|
| Tide Ultra (65 g) | 80 |
| Attack (20 g) (Kao Corp., available in Japan) | 80 |
| Enzyme Top (20 g) (Lion, available in Japan) | 45 |
| Amway SA8 Phosphate Free (60 g) | 100 |
| Amway Japanese SA8 Phosphate Free (25 g) | 70 |

The Amway SA8 Phosphate Free formula has the following ingredients: 61.27% sodium carbonate, 3% sodium citrate, 2% cellulose gum, 2.0% sodium salt of an anionic polymer, 4.4% sodium silicate (spray dried), 14.5% Pareth 25–7 (a $C_{12}$–$C_{15}$ alcohol with 7 moles of ethylene oxide), 11.0% liquid sodium silicate, and 3.83% of detergent ingredients (enzymes, fragrance, whitener, brightener, PVP, soil dispersant, sodium hydroxide) with 2% water loss to drying.

The Amway Japanese SA8 Phosphate Free formula has the following ingredients: 62.02% sodium carbonate, 2.8% cellulose gum, 1.0% sodium salt of anionic terpolymer, 4.4% sodium silica, 3.0% sodium citrate, 11.05% of a mixture of Pareth 25–7 and Pareth 45–7 (a $C_{,12}$–$C_{15}$ alcohol with 7 moles of ethylene oxide and a $C_{14}$–$C_{15}$ alcohol with 7 of ethylene oxide, respectively), 1.7% Pareth 25–3 (a $C_{12}$–$C_{15}$ alcohol with 3 moles of ethylene oxide), 11% liquid sodium silicate, 6.03% detergent ingredients (fragrance, enzyme, whitener, brightener, soil dispersant, quaternary ammonium, sodium hydroxide) added after drying (loss of 3% water).

It should be understood that a wide range of changes and modifications can be made to the embodiments described above. It is therefore intended that the foregoing description illustrates rather than limits this invention, and that it is the following claims, including all equivalents, which define this invention.

What is claimed is:

1. A powder laundry detergent composition comprising:

a. from about 85% to about 99% by weight of detergent base particles comprising i. from about 5% to about 80% by weight of an inorganic carrier; and ii. from about 1% to about 90% weight of a detergent surfactant selected from the group consisting of nonionic surfactants and wherein the nonionic surfactant is the sole detergent surfactant; and b. from about 0.1% to about 15% by weight of the detergent composition of separate acidulant particles, wherein the acidulant particles are fumario acid.

2. The laundry detergent composition of claim 1 wherein the inorganic carrier is an alkali metal carbonate.

3. The laundry detergent composition of claim 1 wherein the nonionic surfactant has the formula $R^1(OC_2H_4)_nOH$, where $R^1$ is a $C_8$–$C_{18}$ alkyl group or a $C_8$–$C_{12}$ alkyl phenyl group, and n is from 3 to about 80.

4. The laundry detergent composition of claim 1 wherein the weight ratio of detergent surfactant to acidulant is from about 2:1 to about 15:1.

5. The detergent composition of claim 1 wherein the detergent base particles and the acidulant particles are admixed thereby forming a non-caking powder laundry detergent.

6. A phosphate-free powder laundry detergent composition comprising:

a. from about 85% to about 99% by weight of agglomerated detergent particles comprising from about 5% to about 80% by weight of an alkali metal carbonate and from about 1% to about 90% by weight of a nonionic detergent surfactant, wherein the nonionic surfactant is the sole detergent surfactant present; and b. from about 0.1% to about 15% by weight of the detergent composition of an acidulant, wherein the acidulant fumaric acid.

7. The composition of claim 6 wherein the weight ratio of nonionic detergent surfactant to acidulant is from about 2:1 to about 15:1.

8. A method of making a powder laundry detergent composition comprising the steps of:

a. providing a powder laundry detergent base comprising from about 5% to about 80% by weight of an alkali metal carbonate and from about 1% to about 90% by weight of a nonionic surfactant having the formula $R^1(OC_2H_4)_nOH$, where $R^1$ is a $C_8$–$C_{18}$ alkyl group or a $C_8$–$C_{12}$ alkyl phenyl group, and n is from 3 to about 80, wherein the nonionic surfactant is the sole detergent surfactant; and b. admixing to the detergent base an acidulant in its acid form and in an amount from about 0.1% to about 15% by weight of the powder detergent composition, wherein the acidulant is selected from the group consisting of acids that in its acid form is soluble in water in an amount not greater than about 8% by weight and in its salt form is soluble in water at least about 15% by weight.

9. A process for making a phosphate-free detergent composition comprising:

a. agglomerating a mixture comprising from about 5% to about 80% by weight of sodium carbonate with from about 1% to about 90% by weight of a nonionic detergent surfactant wherein the nonionic detergent surfactant is the sole detergent surfactant present;

b. drying the agglomerated particles to form an agglomerated powder; and c. admixing to the agglomerated powder an acidulant in its acid form and in an amount from about 0.1% to about 15% by weight of the powder detergent composition, wherein the acidulant is selected from the group consisting of acids that in its acid form is soluble in water in an amount not greater than about 8% by weight and in its salt form is soluble in water at least about 15% by weight.

* * * * *

UNITED STATES PATENT AND TRADEMARK OFFICE

CERTIFICATE OF CORRECTION

PATENT NO. : 5,990,068

DATED : November 23, 1999

INVENTOR(S) : Steven J. Brouwer et al.

It is certified that error appears in the above-identified patent and that said Letters Patent is hereby corrected as shown below:

On the Title Page

In column 1, item [73], insert --Ada,-- before "Mich.".

In claim 1, line 12, delete "fumario" and substitute --fumaric-- in its place.

In claim 6, line 11, insert --is-- after "acidulant".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*